United States Patent [19]

Vogel

[11] 4,170,179

[45] Oct. 9, 1979

[54] RAILWAY VEHICLE STEERING TRUCK

[75] Inventor: Hans H. Vogel, Tuttwil, Switzerland

[73] Assignee: Schweizerische Lokomotive- und Maschinenfabrik, Winterthur, Switzerland

[21] Appl. No.: 794,377

[22] Filed: May 6, 1977

[30] Foreign Application Priority Data

May 7, 1976 [CH] Switzerland ..... 5734/76

[51] Int. Cl.[2] ..... B61F 3/08; B61F 5/20; B61F 5/30; B61F 5/44

[52] U.S. Cl. ..... 105/168; 105/199 R; 105/218 A; 105/224 R; 105/176

[58] Field of Search ..... 105/167, 168, 176, 165, 105/210, 218 A, 218 R, 224 R, 224.1, 166, 199 R

[56] References Cited

U.S. PATENT DOCUMENTS

| | | | |
|---|---|---|---|
| 424,089 | 3/1890 | Bosdevex | 105/168 |
| 476,244 | 6/1892 | Brill et al. | 105/210 |
| 727,919 | 5/1903 | Ellery | 105/168 |
| 1,138,357 | 5/1915 | Curmen | 105/165 |
| 1,388,508 | 8/1921 | Brilhart | 105/168 X |
| 2,347,387 | 4/1944 | Aurien | 105/218 R X |
| 2,594,734 | 4/1952 | Cripe | 105/167 |
| 2,846,954 | 4/1958 | Gaynor | 105/168 X |

FOREIGN PATENT DOCUMENTS

| | | | |
|---|---|---|---|
| 1455148 | 2/1969 | Fed. Rep. of Germany | 105/218 A |
| 1294409 | 5/1969 | Fed. Rep. of Germany | 105/218 A |
| 464379 | 4/1937 | United Kingdom | 105/168 |

*Primary Examiner*—Albert J. Makay
*Assistant Examiner*—Howard Beltran
*Attorney, Agent, or Firm*—Kenyon & Kenyon

[57] ABSTRACT

The structural arrangement relates to a steering apparatus for rail vehicles which have a vehicle body, at least two trunks movably mounted to the body, at least two sets of wheels rotatably mounted in each truck by lateral wheel bearings. At least one of the set of wheels must be mounted for rotation about a vertical axis. In the steering apparatus, there are at least two guide rods pivotally mounted around the circumference of at least one of the wheel bearing housings. One of the guide rods is pivotally mounted to the truck and the second guide rod is pivotally connected to a positioning lever which is pivotally mounted to the vehicle body.

16 Claims, 10 Drawing Figures

RAILWAY VEHICLE STEERING TRUCK

This invention relates to a rail vehicle with a vehicle body and at least two trucks which are movably connected thereto and are each supported on at least two sets of wheels rotatably supported in lateral bearings. At least one of the wheel sets is rotatable about a substantially vertical axis and at least one of its bearings is equipped with a steering device. The steering device comprises two guide rods which engage the bearing box, offset relative to each other in the circumferential direction and extend substantially in the longitudinal direction of the vehicle and, of which the first is connected to its own truck and the second to a positioning part movable relative to the latter.

As is well known, the steering device is to position the wheel set in question, at least approximately, radially with respect to the arc of the track in order to obtain a reduction of the forces acting between the wheel and the track transversely to the direction of travel and thereby allows higher travel velocities with minimum wear on the rail vehicle and the track.

In one known steering device of the type mentioned, the second guide rod is connected to the piston of a hydraulic positioning device which is controlled via a separate control system. Such control systems generally require a relatively elaborate design with many parts. The relatively small positioning movements required for the radial adjustment of the axles necessitate control parts of high precision which must be maintained over extended periods of operation.

Accordingly, it is an object of the invention to provide a steering device that properly aligns the wheels and axles of railway vehicles in railway tracks as the vehicle goes through curves.

It is another object of the invention to reduce strain and wear on the running gear of railway vehicles caused by the wheel sets not being properly aligned in tracks when going through curves.

It is another object of the invention to provide a steering apparatus for railway vehicles to properly align the wheels in the tracks around curves so that the vehicle can be pulled through the curve at a higher speed.

It is another object of the invention to provide a steering apparatus that is simple, rugged and requires little maintenance.

It is another object of the invention to provide a rail vehicle which is improved in this respect, requires little maintenance and ensures, with parts as simple as possible, reliable transmission of the positioning movements to the respective wheel set.

Briefly, the invention provides a steering apparatus for rail vehicles which have two trucks movably mounted on a vehicle body, each truck having two sets of wheels mounted for rotation in lateral wheel bearings with at least one set of wheels sdopted to rotate about a vertical axis. The apparatus has at least two guide rods pivotally mounted around the circumference of the wheel bearing housing.

The first of the guide rods is pivotally connected to a truck and the second of the guide rods is pivotally mounted to positioning means which is movably mounted to the vehicle body.

The positioning means associated with the second guide rod is connected to the vehicle body or to the other truck. By this connection, the positioning movement for the wheel set is derived directly from the excursion of the determining part of the vehicle, which moves relative to the first truck. The movement of the determining part of the vehicle is transmitted to the wheel set in question when it is entering the transition curve, without the interposition of special control elements and, therefore, without the corresponding delay through the use of a simple linkage arrangement of rugged design, such as is customary in rail car construction.

In a further embodiment of the invention, the positioning part can be a rocking lever which is pivoted at its own truck and which is connected to a third guide rod which is pivotally attached to the vehicle body or to the other truck. The ratio of the relative motion of the vehicle part determining the positioning to the motion to be transmitted to the wheel set can be selected through a relatively wide range by varying the ratio of the lever arm associated with the third and the second guide rod.

In another particularly simple embodiment of the invention, which is well suited for retrofitting an already existing vehicle, the positioning part can be a component which is arranged substantially in a fixed relationship to the vehicle body or to the other truck. This arrangement is particularly paractical of a single wheel set of the respective truck is to be positioned.

In another embodiment of the invention, the steering device can be combined with other already provided positioning parts of the rail vehicle. This can be accomplished if the rocking lever is a transversely disposed, two-arm movable beam which is rotatable about a vertical axis and the third guide rod is a tie rod which extends in the longitudinal direction of the vehicle and is pivotally mounted on one arm of the movable beam and serves for transmitting the traction force between the truck and the vehicle body.

In an embodiment with a steering device for a second wheel set, it is practical if the second guide rod of the second steering device is pivoted at the rocker arm, where the junction of the rocker arm to its own truck is located, between the pivots of the two second guide rods. In this arrangement, the two wheel sets are positioned together by actuation of the rocker arm, being rotated about their vertical axes in opposite directions of rotation.

In a further embodiment of the invention, a nearly ideal adjustment of the wheel sets can be achieved if the second guide rods of the two steering devices are associated with the two wheel sets of the same truck.

In order to prevent material wear at the pivot points, and particularly knocking-out of joints, it is advantageous to provide at the points of the steering device respective rubber-elastic intermediate pieces which are arranged between the two cooperating parts and are connected to each of these parts in a slide-proof manner.

These and other objects and advantages of the invention will become more apparent from the following detailed description and appended claims taken in conjunction with the accompanying drawings in which:

Figure 1:
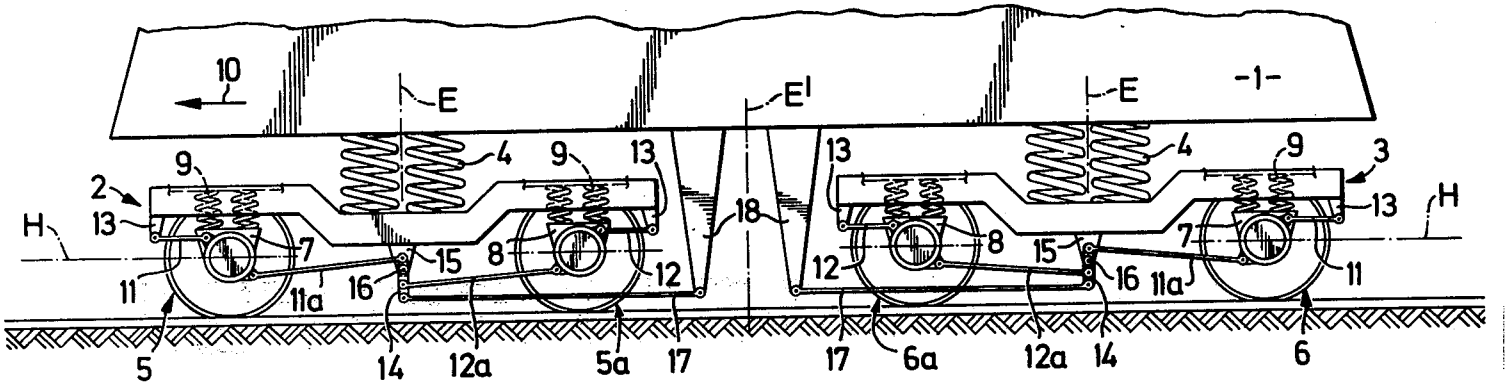
FIG. 1 is a partial side view of the first embodiment of the invention.

Referring to FIG. 1, the rail vehicle comprises a vehicle body 1 and two trucks 2 and 3 which are movably connected to the vehicle body 1 via a device, not shown, for transmitting the traction force. This device can contain, in a manner known per se, a king pin arranged in the center of the truck or a low-level pulling device with a vertical pivot. The trucks 2 and 3 may also be movable relative to the vehicle body 1 in the transverse direction. Each of the trucks 2 and 3 is provided in the region of its transversal center plane E with two pairs of laterally disposed springs 4 on which the vehicle body 1 is supported.

The trucks 2, 3 each contain two wheel sets 5, 5*a* and 6, 6*a* with rotatably mounted axle bearings 7, 8 on which the truck frames are movably supported via compression springs 9. The axle bearings 7, 8 are each steered by two guide rods 11, 11*a* and 12, 12*a*, respectively of the steering device. The axle bearings of the other side of the vehicle (not shown in FIG. 1) are equipped with corresponding pairs of guide rods of the steering device.

The guide rods 11, 11*a* and 12, 12*a* are pivotally mounted and diametrically offset at the housing of the respective axle bearing 7, 8, above and below a horizontal plane H passing through the center of the axles where the guide rods engaging the same axle bearing 7 or 8, respectively, point in opposite lengthwise directions of the vehicle. The first guide rods 11, 12 of the same truck 2 or 3 engaging above the horizontal plane H are facing the respective end of the adjacent truck and are pivoted at a bracket 13 arranged there. The second guide rods 11*a*, 12*a* which engage the same truck 2 or 3 below the horizontal plane H point in opposite directions and are pivotally mounted on a movable lever 14 which is pivotally mounted on a pin 16 on a bracket 15 arranged on the truck frame and which acts as a positioning means of the steering device. The pivot point for the pin 16 is substantially centered between the pivot points of the guide rods 11*a*, 12*a*.

At each of the levers 14, a third guide rod 17 is pivotally mounted which extends toward a longitudinal transverse center plane E' of the vehicle body 1 between the trucks 2, 3 which is pivotally mounted on a bracket 18 which projects downward from the vehicle body 1. The brackets 18 are arranged to the side of the space between the trucks 2, 3. In FIG. 1, the corresponding parts 11 to 18 at the two trucks 2, 3 are arranged substantially symmetrically to the transverse center plane E'.

In negotiating a track curve, the two trucks 2, 3 are rotated in a horizontal plane about their vertical pivots in opposite directions relative to the vehicle body 1 in a manner known per se. Assuming travel in the direction of the arrow 10, the truck 2 is rotated, for instance in a left curve, counterclockwise and the truck 3 clockwise, the brackets 15 and 18 visible in FIG. 1 approaching each other and the levers 14 being tilted by the guide rods 17 clockwise at the truck 2 and counterclockwise at the truck 3. Similarly, the axle bearings 7, 8, visible at each truck 2 and 3 in FIG. 1, are rotated by the guide rods 11*a* and 12*a* in opposite directions about the wheel axles in such a manner that they are each rotated about the pivot of the guide rod 11 or 12, respectively, toward the center plane E.

As the pivot points of the guide rods 11, 11*a* and 12, 12*a* are offset at the axle bearings 7, 8 relative to the horizontal plane H, the result from the relative motions of the guide rods 11*a*, 12*a* are accordingly reduced (i.e. of half the magnitude) displacement motions in the region of the horizontal plane H. Thereby, the fine positioning motions required for the radial positioning of the wheel axles can be derived from relatively large steering motions of the positioning parts, which can accordingly be built ruggedly. The ratio of the deflection motion of the truck 2 or 3 to the positioning motion of the axle bearings 7 and 8 is furthermore determined by the ratio of the distances of the pivot points of the guide rods 11*a*, 12*a* and the guide rod 17 to the pin 16. If the ratio of the lever arms is chosen suitably, a radial position of the wheel sets 5, 5*a*, 6, 6*a* with respect to the track curve negotiated or to be negotiated is achieved at least in approximation.

In negotiating a right curve in the travel direction according to the arrow 10, the trucks 2, 3 are correspondingly rotated in opposite directions so that the distances between the brackets 15 and 18 are increased. By the corresponding tilting motions of the levers 14, the axle bearings 7, 8 of each truck 2, 3 are pushed apart, so that the wheel sets 5, 5*a* and 6, 6*a* are moved toward the respective radial position for the right curve.

Figure 2:
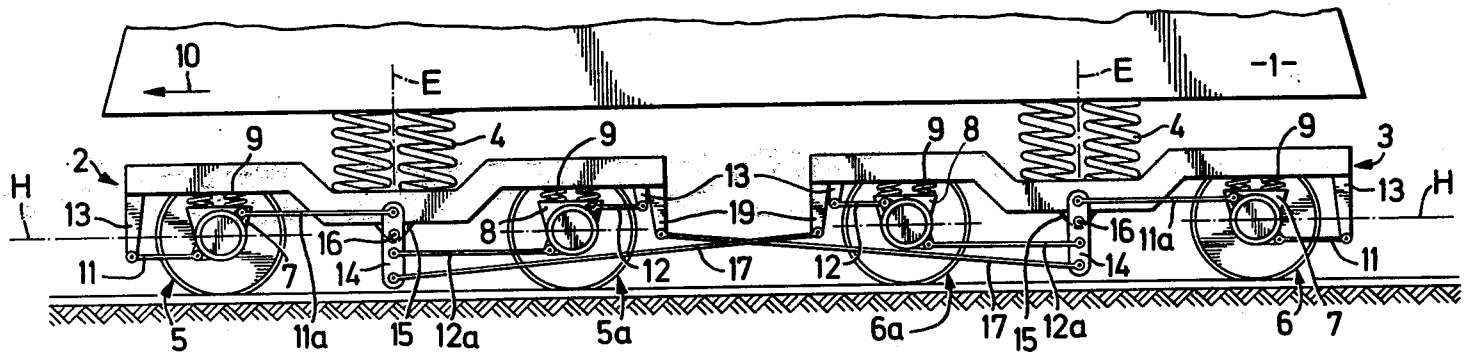
FIG. 2 is a partial side view of the second embodiment of the invention.

In the rail vehicle according to FIG. 2, the wheel sets 5, 5*a*, 6, 6*a* are steered similarly as in FIG. 1, the guide rods 11 being arranged at the two trucks 2, 3 below the horizontal plane H and the guide rods 11*a*, above the horizontal plane H; the guide rods 17 are connected to a bracket 19 of the respective other truck 3 or 2. The brackets 19 are arranged at the truck ends facing each other.

In the already described rotary motions of the trucks 2 and 3 in negotiating a track curve, the levers 14 which act as positioning means are tilted from the respective other truck 3 or 2 via the respective guide rods 17 in the manner described, so that the axle bearings are accordingly moved toward each other or away from each other.

Figure 3:
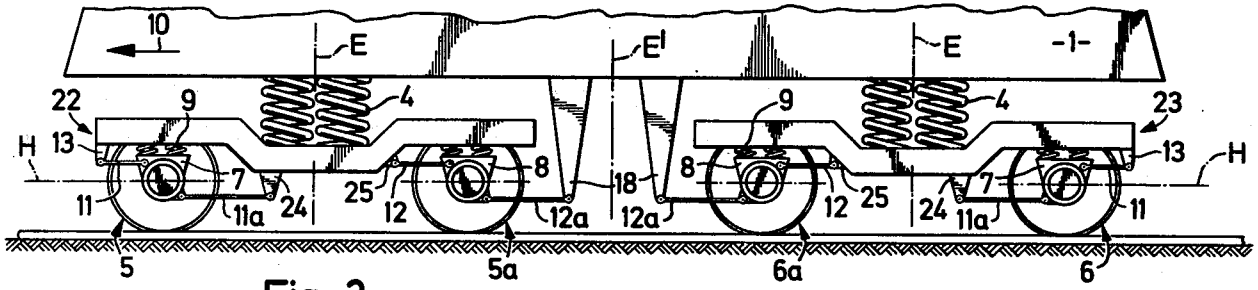
FIG. 3 is a partial side view of the third embodiment of the invention.

The rail vehicle according to FIG. 3 comprises two trucks 22 and 23, in which only the two middle wheels sets 5*a* and 6*a* are steered so that they can be adjusted radially by the guide rods 12*a*. The two outer wheel sets 5 and 6 each are guided parallel to the adjacent transverse center plane E, as the guide rods 11*a* are each pivoted at a bracket 24 arranged at its own truck 22 or 23. The guide rods 12 engaging the axle bearings 8 extend toward the respective transverse center plane E of their own truck 22, 23 and are pivotally mounted on a bracket 25 arranged at the truck frame, while the guide rods 12*a* extend toward the transverse center plane E' and are pivotally mounted on the adjacent bracket 18 of the vehicle body 1 which bracket 18 acts as a positioning means.

In the track arc, the wheel sets 5a and 6a are positioned via the respective guide rods 12a according to the position of the truck 22 or 23 rotated relative to the vehicle body 1 from the latter. In the assumed left curve which is to be negotiated according to the arrow 10 and in which the adjacent truck ends approach each other on the side of the vehicle which is visible in FIG. 3, the respective axle bearings 8 are therefore rotated about their wheel axles by the guide rods 12a in such a manner that they are moved apart, each about the pivot of the guide rod 12, from the position shown in the drawing which they occupy for straight travel. Similarly, the axle bearings of the other side of the vehicle are moved toward each other, so that the middle wheel sets 5a and 6a are each steered toward an at least approximately radial position with respect of the track arc.

Figure 4:
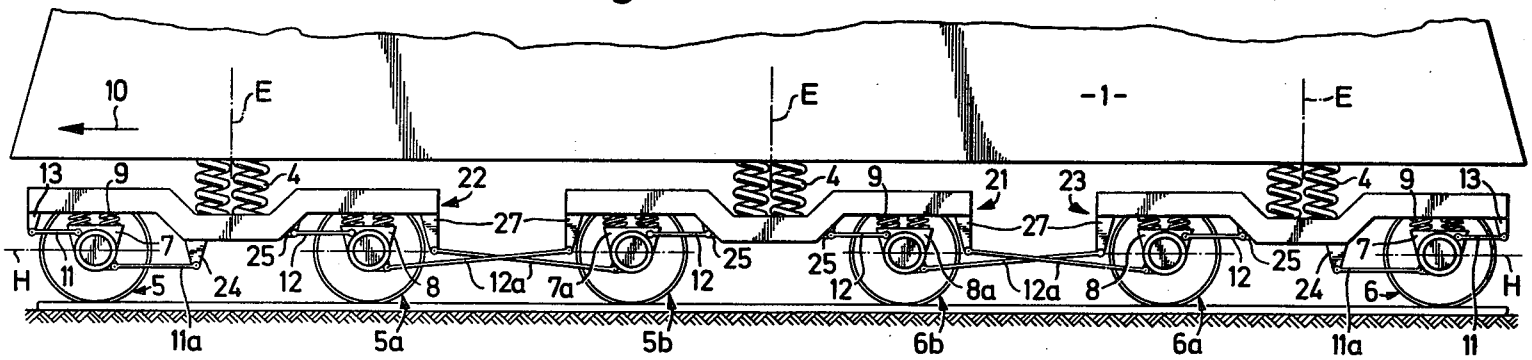
FIG. 4 is a partial side view of the fourth embodiment of the invention.

The rail vehicle according to FIG. 4 comprises two outer trucks 22 and 23 similar to those in FIG. 3 and a truck 21 arranged between them. The latter contains two wheel sets 5b and 6b with axle bearings 7a and 8a, respectively, which are steered by the guide rods 12, which are pivotally mounted at the truck 21 and extend in opposite directions, and the guide rods 12a. The latter are pivotally mounted on respective brackets 27 of the adjacent outer truck 22 or 23, respectively. The two ends of the truck 21 are provided with corresponding brackets 27, at which act as positioning means and at which the guide rods 12a are pivotally mounted to engage the axle bearings 8 of the wheel sets 5a and 6a. In this embodiment the two outermost wheel sets 5, 6 are steered parallel to the transverse center plane E of the truck 22 or 23, while the inner wheel sets 5a, 6a, 5b, 6b can be adjusted, similarly to the already described embodiment examples, by the adjacent truck in the direction toward a radial position with respect to the track curve to be negotiated.

In the embodiments described, it is assumed that there are on the side of the vehicle which is not visible in FIGS. 1 to 4, corresponding steering devices which bring about corresponding opposite adjustment motions of the axle bearings associated with the same wheel axles if the trucks execute the described motions relative to each other or to the vehicle body. The respective wheel sets 5, 5a, 6, 6a, 5b, 6b are therefore rotated about their respective vertical axis which is assumed in the vicinity of the longitudinal center plane of the associated truck.

If the wheel sets 5, 5a, 6, 6a, 5b, 6b are appropriately guided, for instance, by respective vertical king pins arranged in the longitudinal center plane of the trucks 2, 3, 21, 22 or 23, not shown here, the positioning motions can also be obtained by one-sided arranged steering devices, i.e. only for instance, the parts 11, 11a, 12, 12a, 14, 17 visible in FIGS. 1 to 4.

Figure 5:
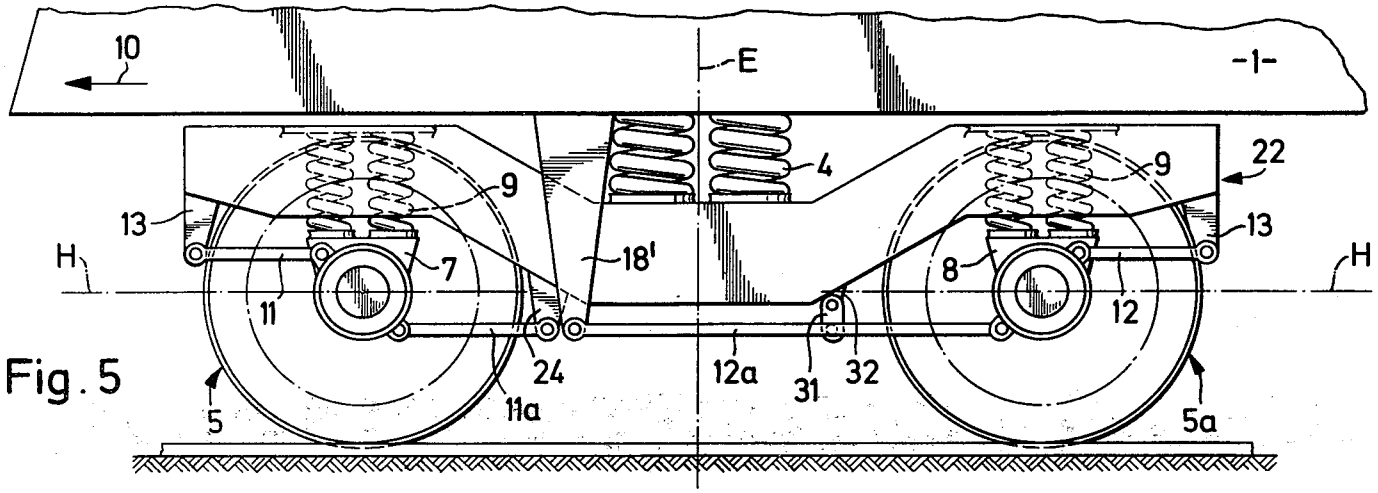
FIG. 5 is a partial side view of the fifth embodiment of the invention.

As shown in FIG. 5, a variant of the embodiment of FIG. 3 is shown, only one of the trucks 22 being depicted in the drawing. The two guide rods 11 and 12 each extend toward the adjacent end of the truck and are pivotally mounted there at the brackets 13. The guide rods 11a and 12a extend in opposite directions, the guide rod 12a extending beyond the region of the transversal center plane E and being pivotally mounted at a bracket 18' of the vehicle body 1 projecting downward to one side of the truck frame. This bracket 18' acts as a positioning means to support the relatively long guide rod 12a, the latter is suspended by a pendulum 31 which divides its free length, can swing in all directions and is pivotally attached to the truck 22 in a bracket 32.

If the truck 22 rotates in a horizontal plane in the track curve counterclockwise in the manner described, i.e. a left curve relative to the direction of travel 10; then the guide rod 12 moves away from the bracket 18' and the axle bearing 8 is rotated clockwise by the guide rod 12a in FIG. 5. Similarly, the end of the wheel axle guided therein is moved from the position shown toward the transverse center plane E, so that the wheel set 5a is rotated, as already described, about its vertical pivot axis in the direction toward radial adjustment with respect to the track arc.

Figure 6:
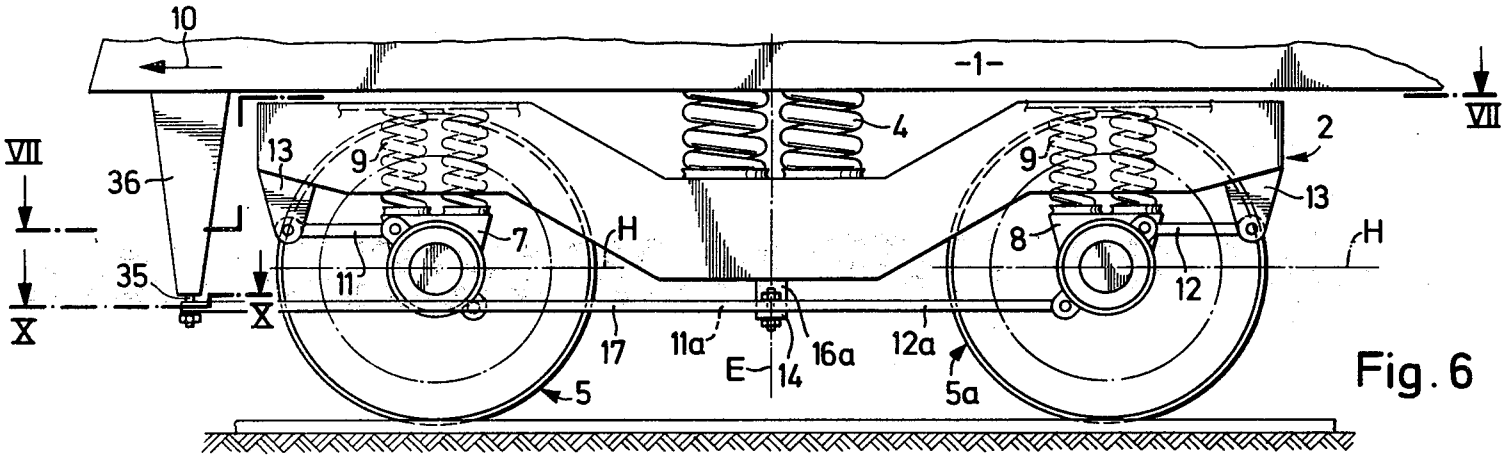
FIG. 6 is a partial side view of the sixth embodiment of the invention.
Figure 7:
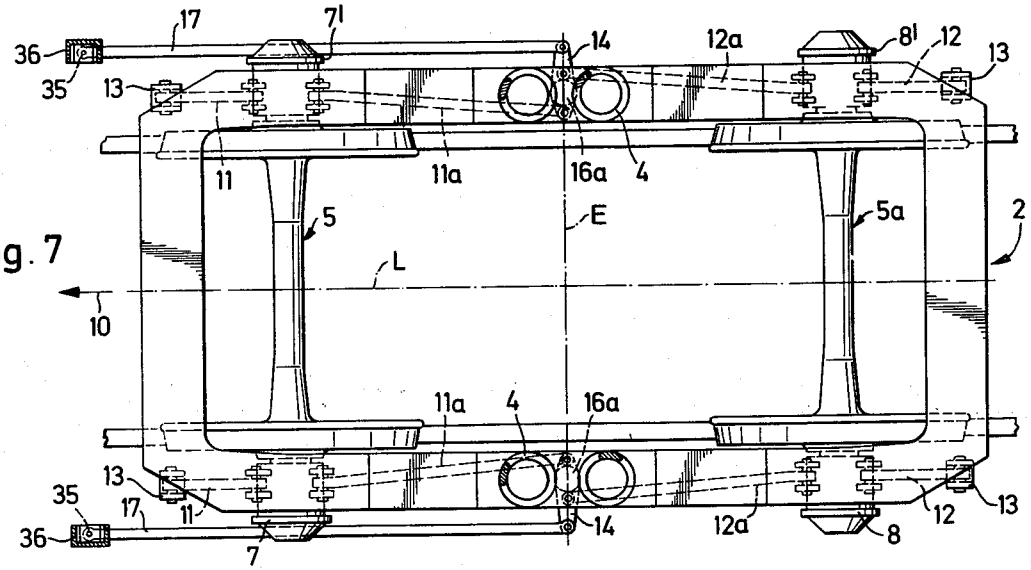
FIG. 7 is a horizontal cross section of the embodiment displayed in FIG. 6 taken along section lines VII—VII.

Also, in the rail vehicle according to FIGS. 6 and 7, only one of the trucks 2 is shown. The design corresponds substantially to that of FIG. 1, with the difference that the levers 14 and the guide rods 617 are arranged to be hinged horizontally. The levers 14 are pivoted at the truck frame at a vertically arranged pivot pin 16a. The guide rods 11a, 12a and 17 are likewise pivotally mounted at the levers 14 hinged about vertical axes. The other ends of the guide rods 17 are pivoted at a respective pivot pin 35 in a bracket 36 arranged at the front end or the rear end (not shown) of the vehicle body 1.

If the truck 2 in FIG. 7 executes a counterclockwise rotary motion in the track curve, the pivot 16a (at the base of FIG. 7) moves away from the associated bracket 36 and the levers 14 are each rotated clockwise about their pivots 16a. The axle bearings 7, 8 approach each other due to the guide rods 11a, 12a, while the corresponding axle bearings 7', 8' on the other side of the vehicle are moved apart by the same amount, which imparts to the wheel axles 5, 5a the desired radial adjustment with respect to the track arc.

Figure 8:
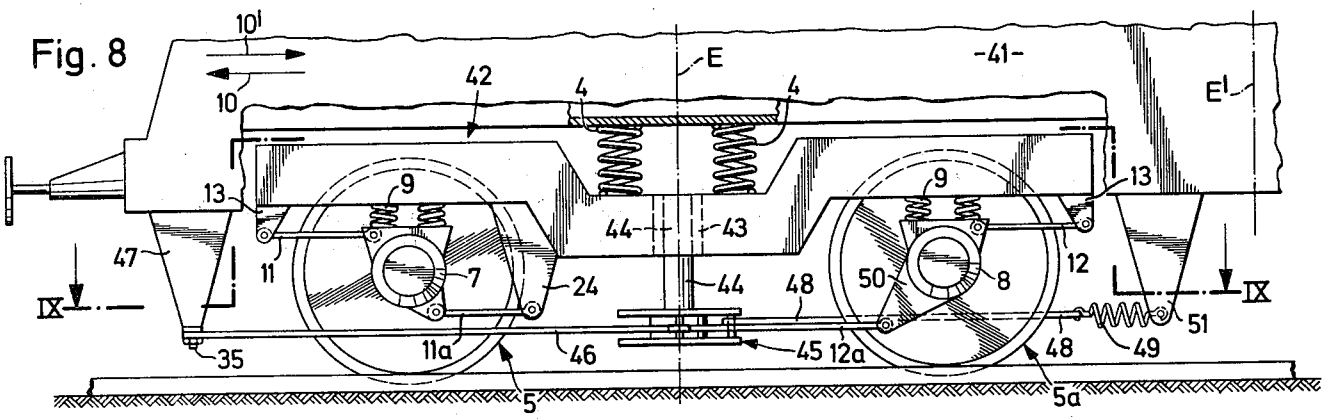
FIG. 8 is a partial side view of the seventh embodiment of the invention.
Figure 9:
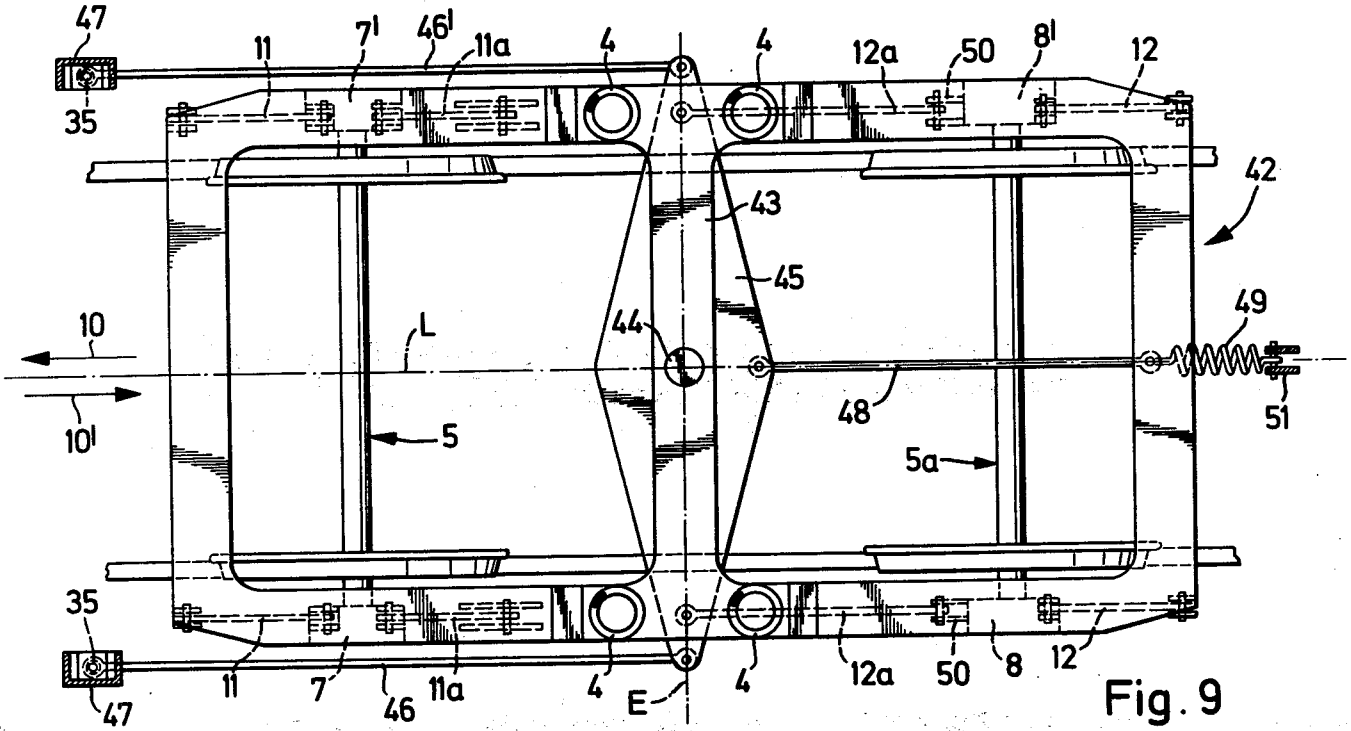
FIG. 9 is a horizontal cross section of the embodiment shown in FIG. 8 taken along section lines IX—IX.

In the embodiment according to FIGS. 8 and 9, a vehicle body 41 is supported on two trucks 42, only one of which is shown. At a cross beam 43 of the truck 42, arranged in the vicinity of the transverse center plane E, a horizontally disposed crosswise movable beam 45 with a vertical pivot pin 44 is pivotally mounted in the longitudinal center plane L to act as a positioning means. The arms of the movable beam 45 protrude laterally beyond the truck frame and are pivotally mounted to two tie rods 46, 46' which in straight travel point in the lengthwise direction of the vehicle. The other ends of the tie rods 46, 46' are pivoted at respective brackets 47 arranged at the adjacent end of the vehicle body 41. The second truck, not shown, is connected via a corresponding pair of tie rods to the other end of the vehicle body. The traction forces are transmitted from the truck 42 to the vehicle body in a manner known per se via the pivot 44, the movable beam 45 and the tie rods 46, 46', assuming a travel direction as per the arrow 10'.

The wheel set 5 is steered by the guide rods 11 and 11a parallel to the transverse center plane E. The wheel set 5a is steered and radially adjusted by the two guide rods 12a, which are pivoted to the movable beam 45 and an arm 50 arranged at the box of the respective axle bearing 8 or 8'. A tie rod 48 pointing toward the transverse center plane E' of the vehicle body 41 is further pivoted at the movable beam 45.

The other end of the tie rod 48 is connected to a tension spring 49, which is fastened to a brcket 51 arranged in the longitudinal center plane L of the vehicle body 41. The tie rod 48 serves to stabilize the movable beam 45, particularly in the transition from curve to straight travel of the vehicle. In addition, the tie rods 46, 46' are thereby pretensioned in such a manner that they transmit only tension forces.

If the truck 42 executes a clockwise rotary motion from the position shown in FIG. 9, the movable beam 45 remains substantially in the position shown. Accordingly, the axle bearing 8 moving away from the movable beam 45 is rotated by the guide rod 12*a* in FIG. 8 clockwise, while the axle bearing 8' approaching the movable beam 45 is rotated counterclockwise and the axle of the wheel set 5*a* is accordingly moved toward the radial position with respect to the track arc.

Figure 10:
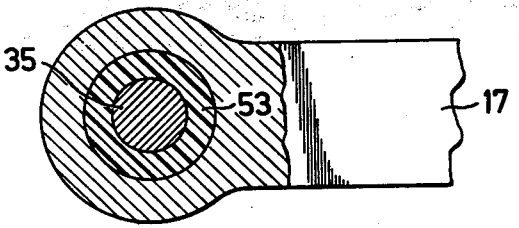
FIG. 10 is a detail horizontal cross section of the embodiment shown in FIG. 6 taken along section line X—X.

In all the embodiments described, intermediate pieces of a rubber-elastic material, e.g. with a silicone rubber base, are provided at the pivot points between the movably connected steering parts. In FIG. 10, one of these pivots points is shown. The elastic intermediate pieces is a ring 53 which is fastened in the hole of the guide rod 17 and is mounted on the pivot pin 35 of the bracket 36, and is firmly connected to the latter. The steering parts which are connected by these rings 53 in a slide-proof manner can therefore execute adjustment motions in space which result from the relative motions of the vehicle parts resiliently braced against each other, without the occurrence of wear and shocks at the pivot points.

The invention is not limited to the embodiment examples shown. For instance, also only a single wheel set may be provided with a steering device, for instance, similar to one of the devices for one of the wheel sets 5*a* or 6*a* in FIG. 3, engaging at the two axle bearings or at a single axle bearing. An embodiment is also conceivable, in which two wheel sets of two different trucks, for instance, the wheel sets of adjacent tracks facing each other are connected to the vehicle body via a common positioning device, for instance, similar to one of the devices for the wheel sets 5, 5*a* or 6, 6*a* respectively, in FIG. 1, or to another part of the vehicle which is movable relative thereto. Furthermore, the first and second guide rods engaging the same bearing boxes need not extend in opposite directions but may have the same longitudinal direction.

What is claimed is:

1. A rail vehicle comprising a vehicle body;

at least two trucks supporting said body and being movably mounted relative to said vehicle body;

at least two sets of wheels mounted in said trucks, each wheel set being rotatably mounted in a set of rotatably mounted lateral axle bearings;

at least one of said set of wheels of one truck being mounted for rotation about a vertical axis; and a steering device for steering said one set of wheels of said one truck about said vertical axis, said steering device comprising at least two guide rods pivotally mounted on one axle bearing of said one set of wheels at diametrically offset points, one of said guide rods being connected to said one truck and a positioning means mounted on one of said vehicle body and said other truck with the other of said guide rods pivotally connected thereto for rotating said one axle bearing about said one set of wheels during negotiation of a track curve.

2. A rail vehicle as claimed in claim 1 wherein said positioning means is a bracket mounted to an adjacent truck.

3. A rail vehicle as claimed in claim 1 wherein said positioning means is a bracket mounted on said vehicle body.

4. A rail vehicle as claimed in claim 1 wherein said positioning means is a lever which is pivotably mounted on said respective truck and wherein said steering device has a third guide rod pivotably mounted to said lever and to a bracket on an adjacent truck.

5. A rail vehicle as claimed in claim 1 which further comprises a rubber elastic means interspaced between each said guide rod and each respective one of said bearing housing, said respective truck and said positioning means.

6. A rail vehicle as claimed in claim 1 wherein said positioning means is a lever which is pivotally mounted on said respective truck and wherein said steering device has a third guide rod pivotally mounted to said lever and to said vehicle body.

7. A rail vehicle as claimed in claim 6 wherein said lever is mounted on a two arm beam which is rotatable about a vertical axis and is transversely mounted on said respective truck and said third guide rod is a tie rod pivotally mounted on one of the arms of said beam and extending longitudinally of said vehicle body for transmitting a force between said respective truck and said vehicle body.

8. A rail vehicle as claimed in claim 6 which further comprises a steering device for steering a second set of wheels comprising a second set of two guide rods mounted on one lateral axle bearing housing of said second set of wheels at diametrically offset points, a first guide rod of said second set pivotally mounted to a respective one of said trucks and a second guide rod of said second set of guide rods being pivotally connected to said lever at an end opposite said other guide rod of said first steering device.

9. A rail vehicle as claimed in claim 8 wherein the second guide rod of said first wheel set and the second guide rod of said second wheel set are associated with the same truck.

10. A rail vehicle comprising a vehicle body;

a pair of trucks movably secured to said vehicle body to support said vehicle body, each said truck having two sets of wheels rotatably mounted therein and a set of rotatably mounted lateral axle bearings rotatably supporting said sets of wheels therein, each set of wheels being mounted for rotation about a vertical axis; and a steering device for steering each set of wheels of a respective truck about a respective vertical axis, said steering device including a first pair of guide rods pivotally secured to one of said lateral axle bearings at diametrically offset points with one of said pair of guide rods pivotally secured to said respective truck, a second pair of guide rods pivotally secured to another of said lateral axle bearings at diametrically offset points with one of said second pair of guide rods pivotally secured to said respective truck, a lever pivotally secured to said respective truck and to each of the other guide rods of each said pair of guide rods, a bracket secured to said vehicle body between said trucks, and a guide rod pivotally secured to said lever at one end and to said bracket at an opposite end whereby during negotiation of a track curve said axle bearings of said wheel sets are rotated about each respective wheel set.

11. A rail vehicle comprising a vehicle body;

a pair of trucks movably secured to said vehicle body to support said vehicle body, each said truck having two sets of wheels rotatably mounted therein and a set of rotatably mounted lateral axle bearings rotatably supporting said sets of wheels therein, each set of wheels being mounted for rotation about a vertical axis; and a steering device for steering each set of wheels of a respective truck about a respective vertical axis, said steering device including a first pair of guide rods pivotally secured to one of said lateral axle bearings at diametrically offset points with one of said pair of guide rods pivotally secured to said respective truck, a second pair of guide rods pivotally secured to another of said lateral axle bearings at diametrically offset points with one of said second pair of guide rods pivotally secured to said respective truck, a lever pivotally secured to said respective truck and to each of the other guide rods of each said pair of guide rods, a bracket secured to the other one of said trucks and a guide rod pivotally secured to said lever at one end and to said bracket at an opposite end whereby during negotiation of a track curve said axle bearings of said wheel sets are rotated about each respective wheel set.

12. A rail vehicle comprising a vehicle body;

a pair of trucks movably secured to said vehicle body to support said vehicle body, each said truck having two sets of wheels rotatably mounted therein and a set of rotatably mounted lateral axle bearings rotatably supporting said sets of wheels therein; and a steering device for steering one set of wheels of a respective truck about a vertical axis, said steering device including a pair of guide rods pivotally secured to said axle bearing of said one set of wheels at diametrically offset points with one of said guide rods pivotally secured to said respective truck and bracket secured to said vehicle body and pivotally secured to the other of said guide rods whereby during negotiation of a track curve said axle bearing is rotated about said one wheel set of a respective truck.

13. A rail vehicle as claimed in claim 12 wherein said bracket is located between said trucks.

14. A rail vehicle as claimed in claim 12 wherein said bracket is located intermediately of a truck.

15. A rail vehicle comprising a vehicle body;

three trucks movably secured to said vehicle body to support said vehicle body, each said truck having two sets of wheels rotatably mounted therein and a set of rotatably mounted lateral axle bearings rotatably supporting said sets of wheels therein; and a steering device for steering at least one set of wheels of each truck, said steering device including a pair of guide rods pivotally secured to one of said lateral axle bearings of each respective one of the leading and trailing trucks of said trucks at diametrically offset points with one of said pair of guide rods pivotally secured to a respective truck and the other of said pair of guide rods pivotally secured to an intermediate truck of said trucks, and a pair of guide rods pivotally secured to each of said lateral axle bearings of said intermediate truck at diametrically offset points with one guide rod of each pair of guide rods pivotally secured to said intermediate truck and the other guide rod of each pair of guide rods pivotally secured to a respective one of said leading and trailing trucks whereby during negotiation of a track curve said one axle bearing of each said one set of wheels of each truck is rotated about a respective wheel set.

16. A rail vehicle comprising a vehicle body, a truck for supporting said vehicle body, said truck being movably mounted relative to said vehicle body and having two sets of wheels rotatably mounted therein and a set of rotatably mounted lateral axle bearings rotatably supporting said sets of wheels therein, at least one of said sets of wheels being mounted for rotation about a vertical axis; and a steering device for steering said one set of wheels about said vertical axis, said steering device including a pair of brackets mounted on opposite sides of said vehicle body, a first pair of guide rods pivotally secured to one lateral axle bearing of said one set of wheels at diametrically offset points, one of said guide rods being pivotally secured to said truck, a second pair of guide rods pivotally secured to a second lateral axle bearing of said one set of wheels at diametrically offset points, one of said guide rods of said second pair being pivotally secured to said truck, a horizontally disposed lever pivotally secured at opposite ends to the other guide rod of each pair of guide rods, said lever being rotatable about a vertical axis and a pair of rods, each said rod being pivotally secured at one end to an end of said lever and at an opposite end to a respective one of said brackets whereby during negotiation of a track curve each said one axle bearing of said wheel sets is rotated about a respective wheel set.

* * * * *

UNITED STATES PATENT AND TRADEMARK OFFICE

CERTIFICATE OF CORRECTION

PATENT NO. : 4,170,179
DATED : October 9, 1979
INVENTOR(S) : Hans Heiner Vogel

It is certified that error appears in the above-identified patent and that said Letters Patent are hereby corrected as shown below:

Column 1, line 57, change "sdopted" to --adopted--

Column 2, line 25, change "paractical" to --practical--

Column 6, line 17, change "617" to --17--

Column 6, line 53, after "pivot" insert --pin--

Column 6, line 65, change "brcket" to --bracket--

Column 7, line 35, change "tracks" to --trucks--

Column 8, line 30, after "bearing" delete --housing--

Column 9, line 43, before "bracket" insert --a--

Signed and Sealed this

*Eighteenth* Day of *March 1980*

[SEAL]

*Attest:*

SIDNEY A. DIAMOND

*Attesting Officer*

*Commissioner of Patents and Trademarks*